US006023127A

United States Patent [19]

Huang

[11] Patent Number: 6,023,127

[45] Date of Patent: Feb. 8, 2000

[54] DECORATION LAMP DEVICE

[76] Inventor: Shun-Feng Huang, No.56, Min Sheng Street, Feng-Yuan City Taichung 42041, Taiwan

[21] Appl. No.: 09/078,896

[22] Filed: May 12, 1998

[51] Int. Cl.[7] ..... H01R 33/00; F21V 31/00

[52] U.S. Cl. ..... 313/318.01; 313/318.05; 313/318.09; 362/226; 362/267; 439/611

[58] Field of Search ..... 313/318.01, 318.03, 313/318.04, 318.05, 318.09, 318.1, 318.12; 362/226, 267; 439/619, 699, 356

[56] References Cited

U.S. PATENT DOCUMENTS 5,013,960 5/1991 Tseng ..... 313/318.01
5,498,922 3/1996 Chang ..... 313/318.09
5,707,138 1/1998 Pan ..... 313/318.01
5,720,544 2/1998 Shu ..... 362/267

*Primary Examiner*—Ashok Patel

[57] ABSTRACT

A decoration lamp device has a bulb, a sleeve having an upper groove receiving the bulb, and a screw base receiving the sleeve. The bulb has a first filament and a second filament. The sleeve has an upper rim, a plurality of protruded bars, the upper groove, a lateral hole communicating with the upper groove, an extended hole communicating with the upper groove, an aperture communicating with the extended hole, a bottom center hole communicating with the aperture, a welded spot positioning the first filament, and a bottom taper flange. The bottom taper flange has a block rim. The screw base has an upper flare flange, a plurality of slots matching the protruded bars, and an outer thread.

2 Claims, 8 Drawing Sheets

DECORATION LAMP DEVICE

BACKGROUND OF THE INVENTION

This invention relates to a decoration lamp device, and more particularly, this invention relates to a decoration lamp device which can position a bulb stably.

Referring to FIG. 1, a conventional lamp has a transparent bulb 2, a screw base 1, and a tip contact 3. The screw base 1 can be engaged with a socket (not shown in the figure).

Referring to FIG. 1A, another conventional lamp has a long bulb 4, a lamp holder 6, and two filaments 5. The lamp holder 6 is inserted in a socket (not shown in the figure). However, the long bulb 4 cannot be inserted in the socket directly.

SUMMARY OF THE INVENTION

A main object of this invention is to provide a decoration lamp device which can position a bulb stably.

Accordingly, a decoration lamp device comprises a bulb, a sleeve having an upper groove receiving the bulb, and a screw base receiving the sleeve. The bulb has a first filament and a second filament. The sleeve comprises an upper rim, a plurality of protruded bars, the upper groove, a lateral hole communicating with the upper groove, an extended hole communicating with the upper groove, an aperture communicating with the extended hole, a bottom center hole communicating with the aperture, a welded spot positioning the first filament, and a bottom taper flange. The bottom taper flange has a block rim. The screw base comprises an upper flare flange, a plurality of slots matching the protruded bars, and an outer thread.

DETAILED DESCRIPTION OF THE INVENTION

Figure 1:
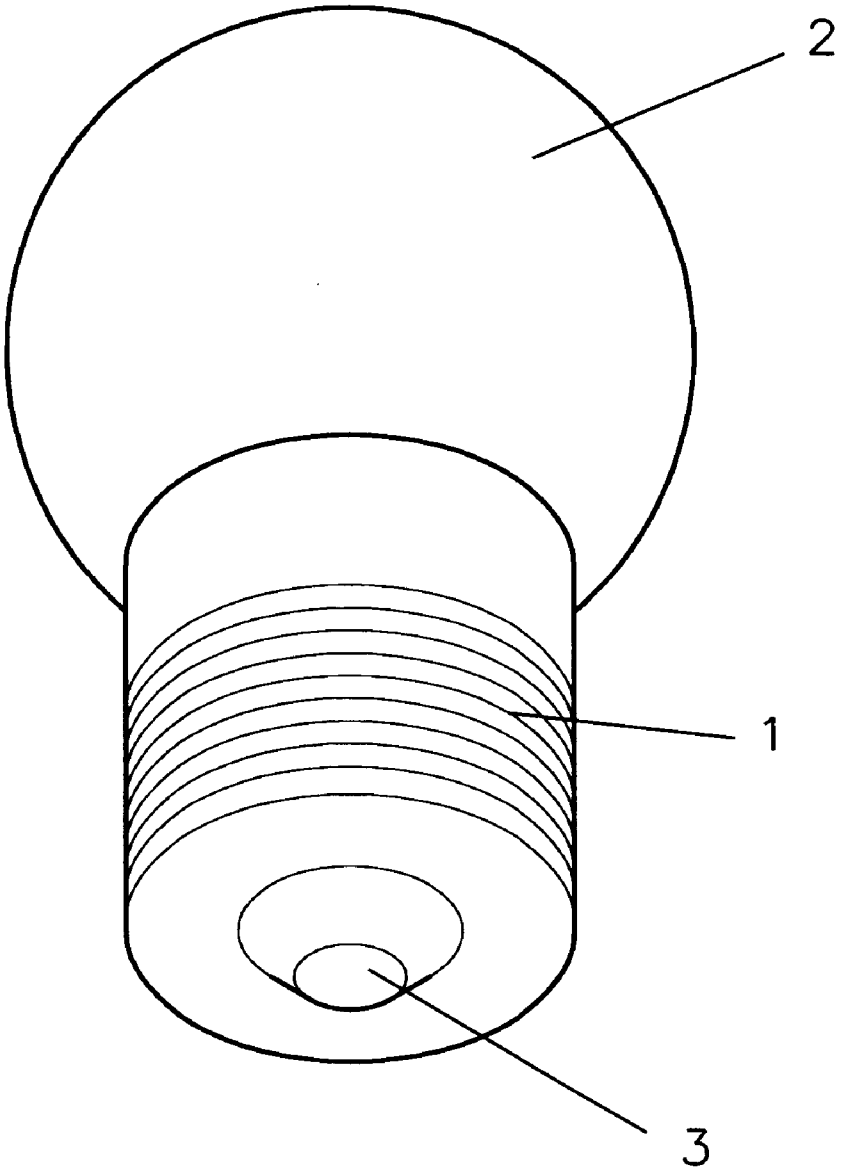
FIG. 1 (Prior Art)
FIG. 1 is a perspective exploded view of a conventional lamp of the prior art.
Figure 1A:
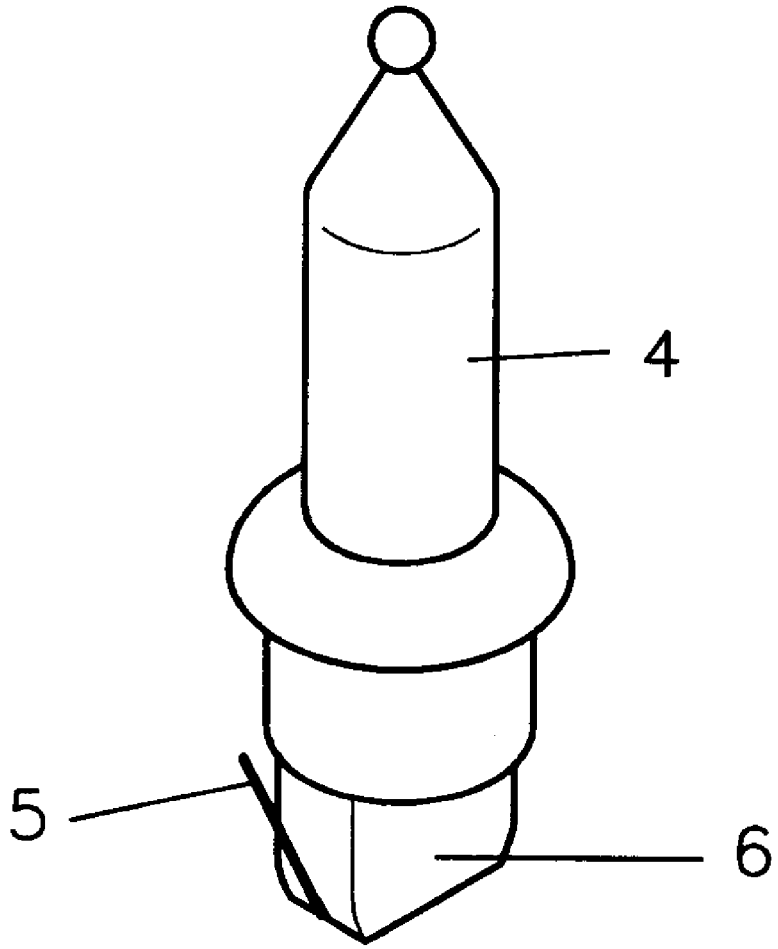
FIG. 1A (Prior Art)
FIG. 1A is a perspective view of another conventional lamp of the prior art.
Figure 2:
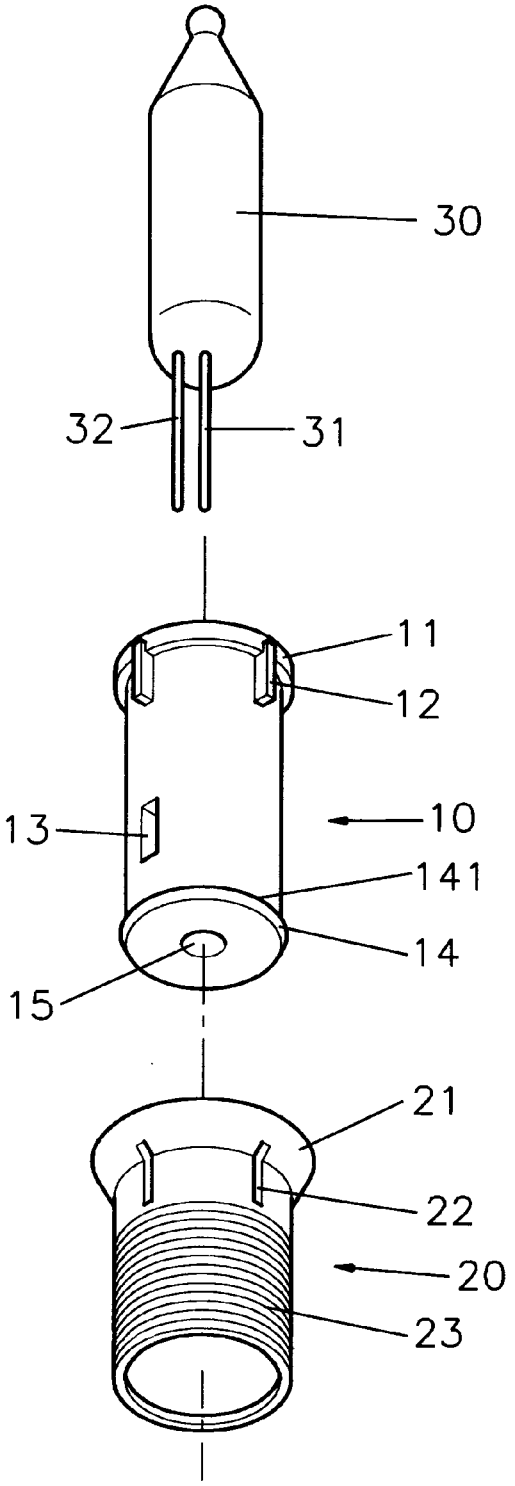
FIG. 2 is a perspective exploded view of a decoration lamp device of a preferred embodiment in accordance with this invention.
Figure 3:
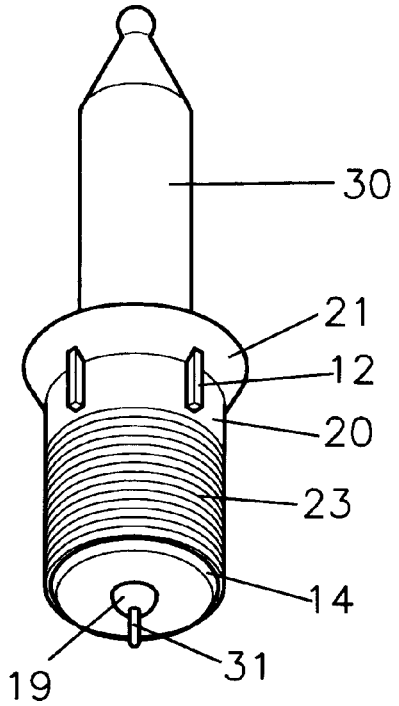
FIG. 3 is a perspective assembly view of a decoration lamp device of a preferred embodiment in accordance with this invention.
Figure 4:
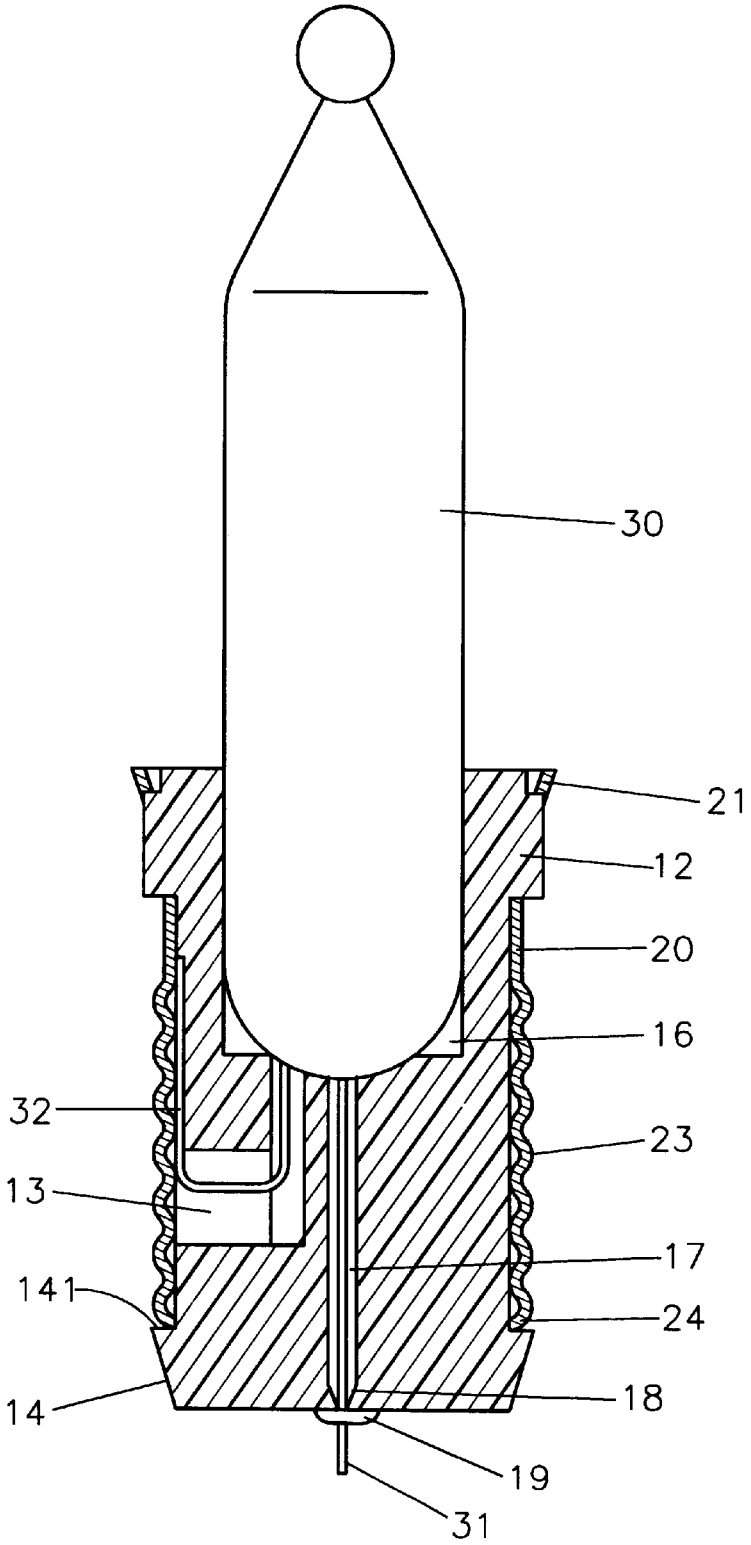
FIG. 4 is a sectional assembly view of a decoration lamp device of a preferred embodiment in accordance with this invention.

Referring to FIGS. 2 to 4, a decoration lamp device comprises a bulb 30, a sleeve 10 having an upper groove 16 receiving the bulb 30, and a screw base 20 receiving the sleeve 10. The bulb 30 has a first filament 31 and a second filament 32. The sleeve 10 comprises an upper rim 11, a plurality of protruded bars 12, the upper groove 16, a lateral hole 13 communicating with the upper groove 16, an extended hole 17 communicating with the upper groove 16, an aperture 18 communicating with the extended hole 17, a bottom center hole 15 communicating with the aperture 18, a welded spot 19 positioning the first filament 31, and a bottom taper flange 14. The bottom taper flange 14 has a block rim 141. The screw base 20 comprises an upper flare flange 21, a plurality of slots 22 matching the protruded bars 12, and an outer thread 23.

The diameter of the bottom taper flange 14 is larger than the diameter of the upper rim 11.

The diameter of the extended hole 17 is larger than the diameter of the aperture 18.

The first filament 31 is inserted through the extended hole 17 and the aperture 18. The welded spot 19 which blocks the bottom center hole 15 positions the first filament 31 stably. The second filament 32 is inserted through the lateral hole 13 and bent upward to contact the screw base 20.

The screw base 20 has a bottom end 24 contacting the block rim 141.

Figure 5:
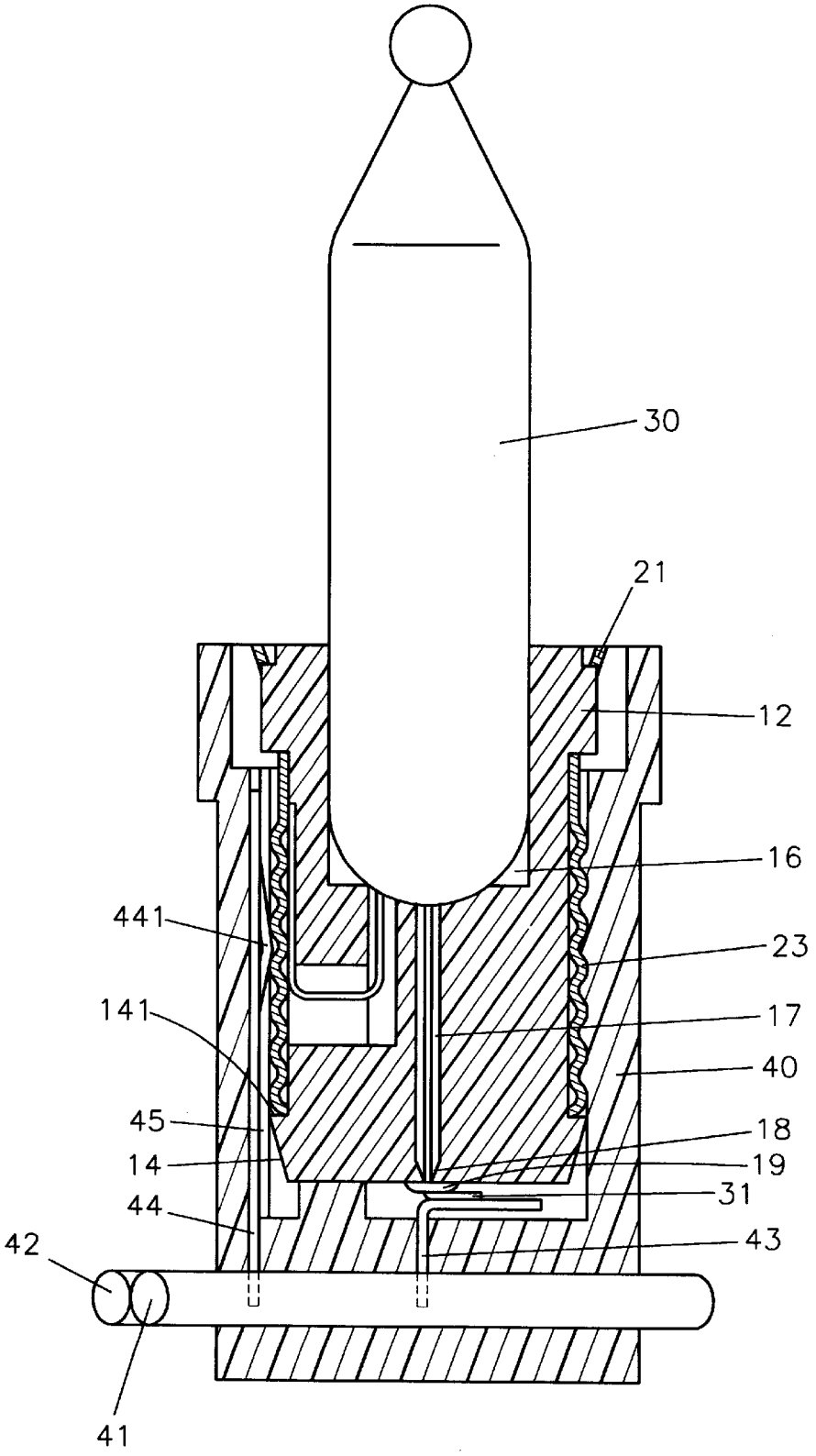
FIG. 5 is a sectional assembly view of a socket and a decoration lamp device of a preferred embodiment in accordance with this invention.

Referring to FIG. 5, the screw base 20 is inserted in a socket 40. A first wire 41 and a second wire 42 are inserted through the socket 40. A first conductive plate 43 is disposed in the socket 40. The socket 40 has an insertion groove 45 receiving a second conductive plate 44. The first conductive plate 43 contacts the first filament 31. The second conductive plate 44 contacts the screw base 20.

Figure 6:
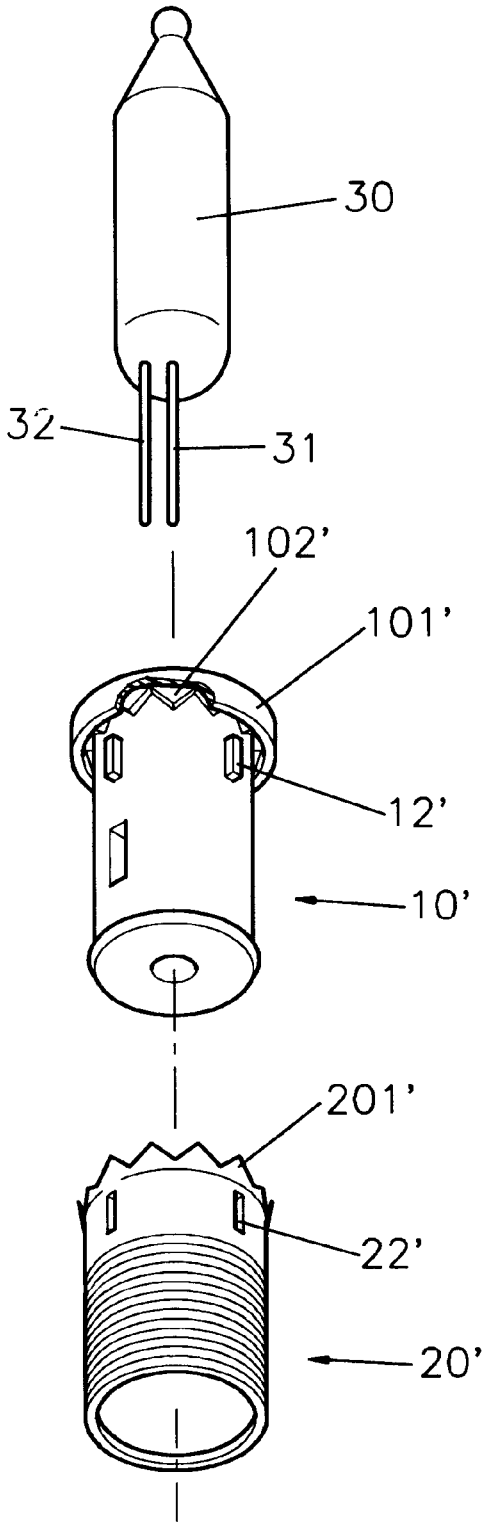
FIG. 6 is a perspective exploded view of a decoration lamp device of another preferred embodiment in accordance with this invention.
Figure 7:
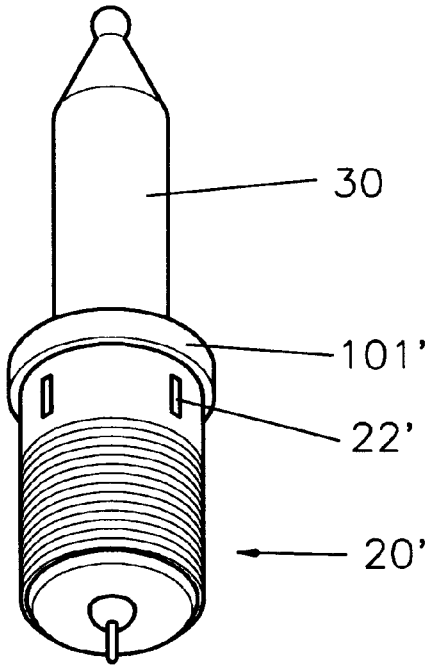
FIG. 7 is a perspective assembly view of a decoration lamp device of another preferred embodiment in accordance with this invention.
Figure 8:
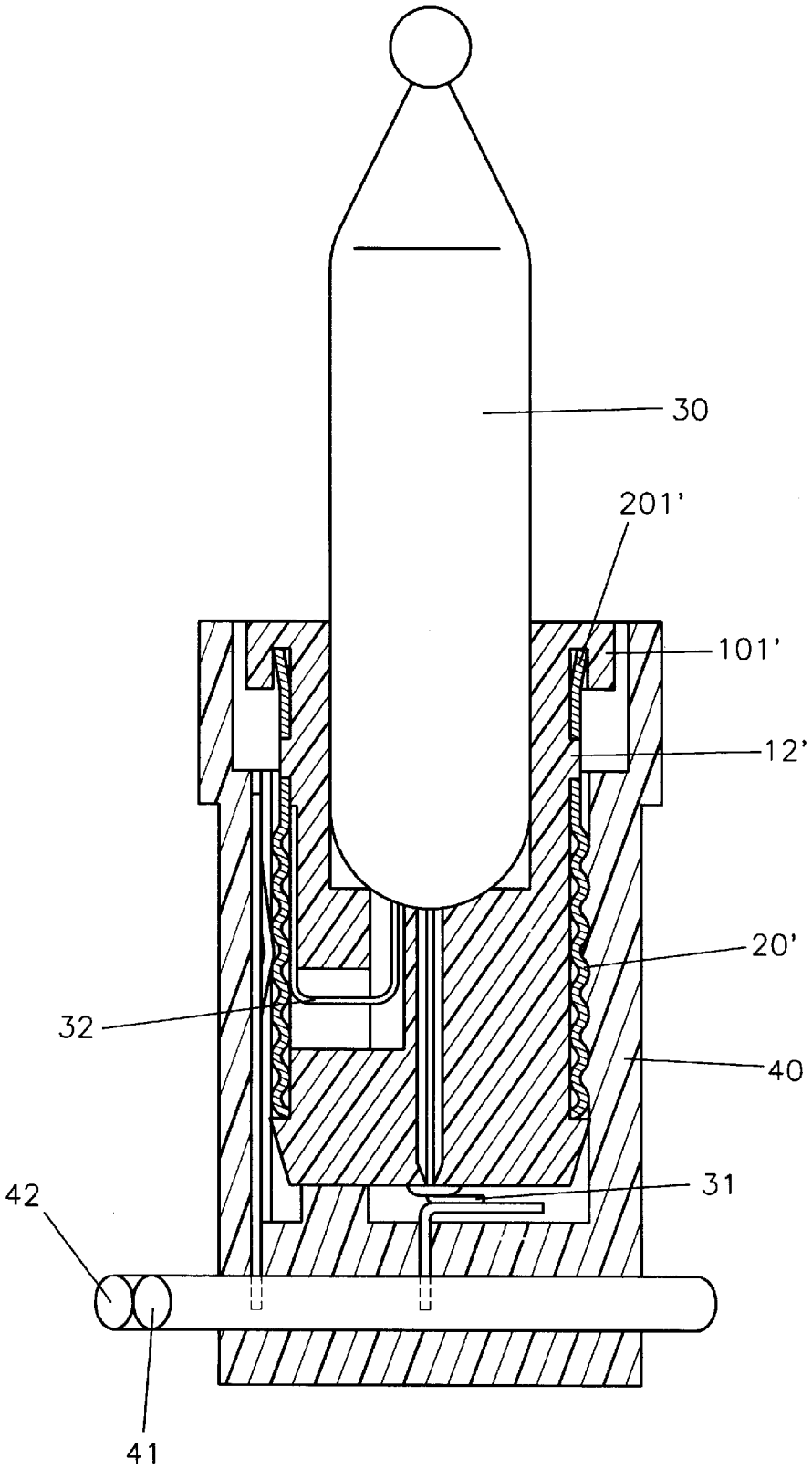
FIG. 8 is a sectional assembly view of a socket and a decoration lamp device of another preferred embodiment in accordance with this invention.

Referring to FIGS. 6 to 8, another decoration lamp device comprises a bulb 30, a sleeve 10' receiving the bulb 30, and a screw base 20' receiving the sleeve 10'.

The bulb 30 has a first filament 31 and a second filament 32. The sleeve 10' comprises an upper rim 101', a plurality of protruded bars 12', and an upper serration portion 102'. The screw base 20' comprises an upper flare flange 21, a plurality of slots 22' matching the protruded bars 12', and a plurality of top serrations 201' engaging with the upper serration portion 102'. The screw base 20' is inserted in a socket 40. A first wire 41 and a second wire 42 are inserted through the socket 40.

Figure 9:
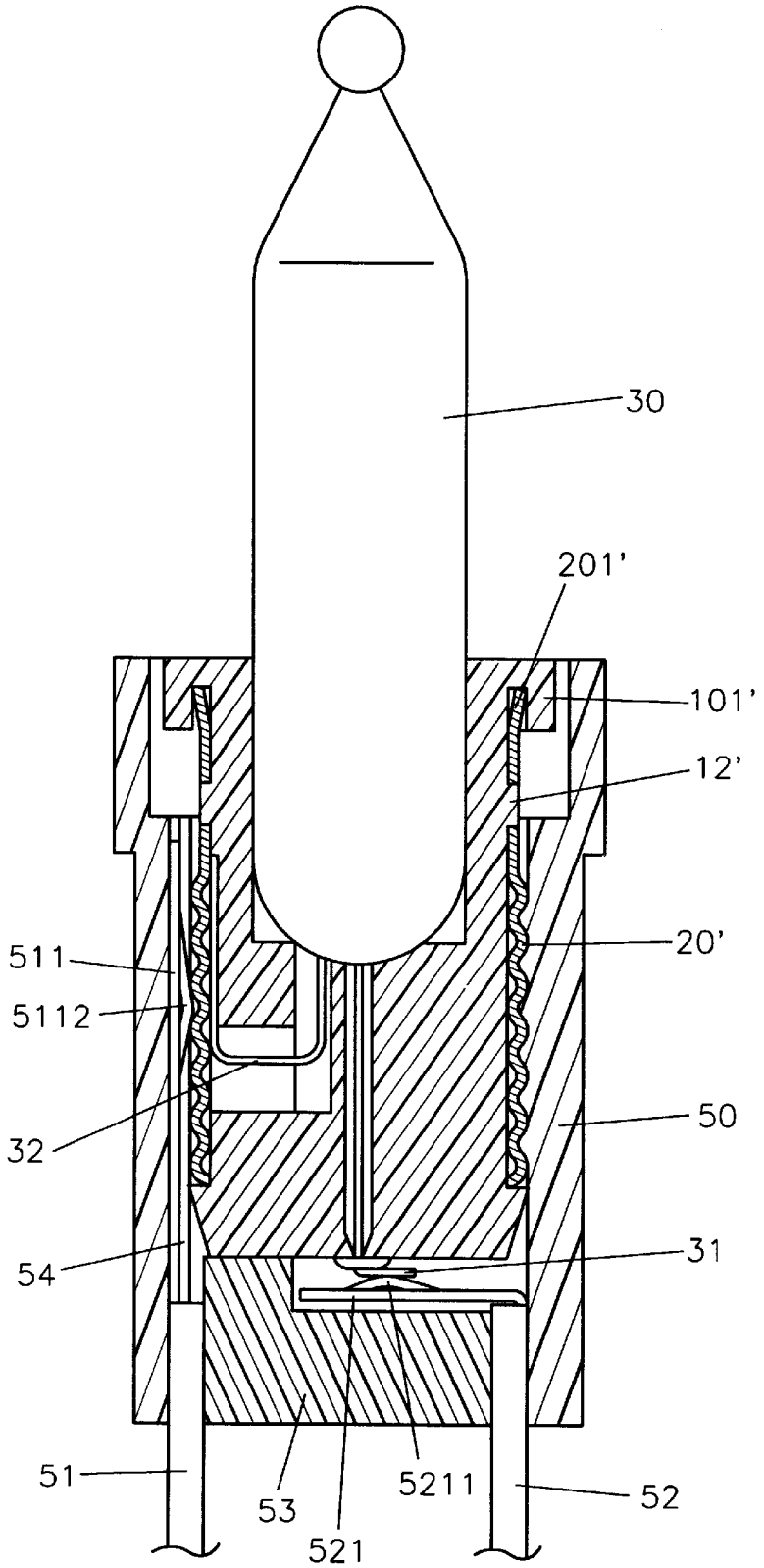
FIG. 9 is a sectional assembly view of another socket and a decoration lamp device of another preferred embodiment in accordance with this invention.

Referring to FIG. 9, another socket 50 comprises a an insertion groove 54 receiving a first conductive plate 511. The first conductive plate 511 has a first elastic protruded plate 5112 contacting the screw base 20'. A second conductive plate 521 has a second elastic protruded plate 5211 contacting the first filament 31. A plug 53 is inserted in a bottom of the socket 50. A first wire 51 is connected to the first conductive plate 511. A second wire 52 is connected to the second conductive plate 521.

I claim:

1. A decoration lamp device comprises:

a bulb, a sleeve having an upper groove receiving the bulb, a screw base receiving the sleeve, the bulb having a first filament and a second filament, the sleeve comprising an upper rim, a plurality of protruded bars, the upper groove, a lateral hole communicating with the upper groove, an extended hole communicating with the upper groove, an aperture communicating with the extended hole, a bottom center hole communicating with the aperture, a welded spot positioning the first filament, and a bottom taper flange, the bottom taper flange having a block rim, the screw base comprising an upper flare flange, a plurality of slots matching the protruded bars, and an outer thread, and each said protruded bar inserted in the respective slot.

2. A decoration lamp device as claimed in claim 1, wherein the sleeve comprises an upper serration portion, and the screw base comprises a plurality of top serrations engaging with the upper serration portion.

* * * * *